US005738389A

United States Patent [19]

Marks

[11] Patent Number: 5,738,389

[45] Date of Patent: Apr. 14, 1998

[54] DOOR SECURING DEVICE

[75] Inventor: Chester J. Marks, Lafayette, La.

[73] Assignee: Marks Family Partnership, LLC of Louisiana, Lafayette, La.

[21] Appl. No.: 621,319

[22] Filed: Mar. 25, 1996

Related U.S. Application Data

[63] Continuation-in-part of Ser. No. 239,679, May 9, 1994, abandoned.

[51] Int. Cl.[6] ..... E05C 5/00

[52] U.S. Cl. ..... 292/63; 292/67

[58] Field of Search ..... 292/63, 67, 300, 292/68, 69, 64, 65, 62

[56] References Cited

U.S. PATENT DOCUMENTS

| | | | |
|---|---|---|---|
| 1,330,237 | 2/1920 | Carrier | 292/64 |
| 1,907,625 | 5/1933 | Vogt | 292/351 X |
| 2,497,425 | 2/1950 | Terry | 292/65 X |
| 2,981,560 | 4/1961 | Wehner | 292/351 X |
| 3,203,718 | 8/1965 | Bishop | 292/62 |
| 3,208,782 | 9/1965 | Zeller | 292/62 X |
| 3,397,000 | 8/1968 | Nakanishi | 292/62 X |
| 3,501,932 | 3/1970 | Bishop | 292/62 X |
| 4,207,655 | 6/1980 | MacMaster | 292/62 X |
| 4,337,972 | 7/1982 | Gill | 292/67 |
| 4,492,394 | 1/1985 | Dignan | 292/64 |
| 4,556,244 | 12/1985 | Bisbing | 292/65 |
| 4,583,775 | 4/1986 | Bisbing | 292/64 |
| 4,635,976 | 1/1987 | Seigler | 292/57 |
| 5,114,193 | 5/1992 | Nass | 292/67 |
| 5,165,738 | 11/1992 | McCormack | 292/67 |
| 5,301,988 | 4/1994 | Davenport et al. | 292/67 |

*Primary Examiner*—Rodney M. Lindsey
*Attorney, Agent, or Firm*—John D. Jeter

[57] ABSTRACT

A door securing device has a body adapted for mounting on the door frame with a generally rectangular plate adjacent the body opposite the frame. The plate is attached to an arbor that slides axially perpendicularly to the inside wall. It is controlled by a groove and lug camming arrangement and can be rotated a selected amount to allow limited axial movement in selected rotational positions. The plate is shaped to clear the door when in a stowed position against the body. Pulled out, or actuated, the plate can rotate to place a plate extension in position to secure the door when slightly opened. The plate is moved back to stowing position by reversing the procedure engages the door in the closed position. A latch and latch release trigger is provided to release the arbor, and the plate, to extend to the actuated position.

13 Claims, 4 Drawing Sheets

DOOR SECURING DEVICE

This application is a continuation in part of application Ser. No. 08/239,679, filed on May 9, 1994 now abandoned.

This invention pertains to means for securing doors of buildings to supplement the conventional key operated locks and latches and non keyed improvements of such security devices. The invention is intended for use by occupants to prevent opening of doors from the outside.

BACKGROUND OF THE INVENTION

In the past, dead bolts and chains have been in common use to limit control of securing devices to inside access. Recently many props and jamming devices have been devised to improve upon the chain. The main problem with chains is the weakness of the usual commercially available systems, the usual ineffective mounting, and the ability to insert chain cutting devices through the opening chains are intended to provide. Dead bolts manageable only from the inside are inoperative when the door is opened any amount. If the dead bolt is key operated from the outside, the key can be compromised by loss or duplication. Further, there are lock forcing devices that can shear the tumblers of most key served locks. There is a need for a door securing system that provides robust means to attach to the structural door opening with equally robust means to secure the door when it is slightly opened. The needed securing system should be easily operated by persons needing to leave a building under stressful circumstances.

It is therefore an object of this invention to provide a door securing system with means to fasten it securely to the structural door opening and to provide strength to restrain the door against further opening when the door is slightly opened.

It is another object of this invention to provide a door securing system that is easily operated rather rapidly without the likelihood of error that would disable the system.

These and other objects, advantages, and features of this invention will be apparent to those skilled in the art from a consideration of this specification, including the attached claims and appended drawings.

SUMMARY OF THE INVENTION

A door lock system for use mounted on an enclosure door frame to prevent the door from being opened from the outside has a mounting body with a base to rest on the door frame, positioned to just clear an opening door. Opposite the base a plate is mounted transversely on an arbor that extends into or through a bore in the body to rotate and slide axially therein. A cam and groove arrangement limits arbor movement to preselected rotational and axial relationships. The plate then is limited to particular relationships to the door. The plate is shaped such that it will stow against the body and clear the opening door. The plate can be moved away from the body by which action the cam and groove allow it to be rotated a half turn to position an extension on the plate to interfere with the door. In that rotational position the plate will allow the door to be opened a small amount but in that extended position the cam prevents the plate from being rotated. The arbor has to be pushed back in near the body to again be rotated to the stowing position where the plate can be pushed against the body for use of the door.

In the simplest configuration the arbor moves axially and rotationally in a constant ratio. That invites the use of mating spiral splines on the arbor and body bore. In the interest of economy, a twisted square arbor and a mating spiraled body bore with a square cross section will suffice. In such cases the cam lug and provisions for its installation can be omitted. If the cam and groove arrangement is used to produce the spiral effect the cam is shaped to cooperate with the spiral groove. That qualifies the cam and groove for the spiraled non-circular cross section definition of mating arbor and bore.

An alternate embodiment provides the plate with a joggled extension so that a flange will extend to hold the door fully closed when the plate is in a selected rotational position relative to the body. In addition to operations previously described, the plate can be pulled out to rotate the flange before the door and then pushed back to the axial stowing position. A spring biased sear locks the arbor until a button is pushed on the plate to release the arbor for further manipulation.

The preferred embodiment provides a spiral arbor groove and includes a latch pin arrangement transverse to the arbor, to cooperate with a sear abutment on the arbor, with a trigger lever on the side of the body and a spring arranged to push the arbor outward. The use of the trigger then allows the trigger pull alone to fully actuate the device. Deactivation of the device results from simply pushing the plate toward the body until the latch pin again engages the arbor.

BRIEF DESCRIPTION OF DRAWINGS

In the drawings wherein like features have similar captions.

DETAILED DESCRIPTION OF DRAWINGS

Figure 1:
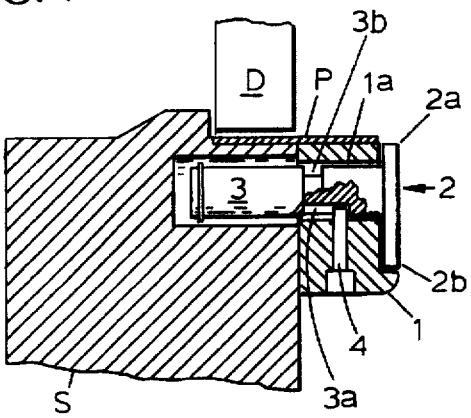
FIG. 1 is a top view, in cutaway, of one embodiment attached to a door frame.

In the drawings certain features bearing upon manufacturing and maintenance utility, well established in the art, and not bearing upon points of novelty may be omitted in the interest of clarity and descriptive efficiency. Such omitted features may include weld lines, some keys and fasteners and the like.

Figure 2:
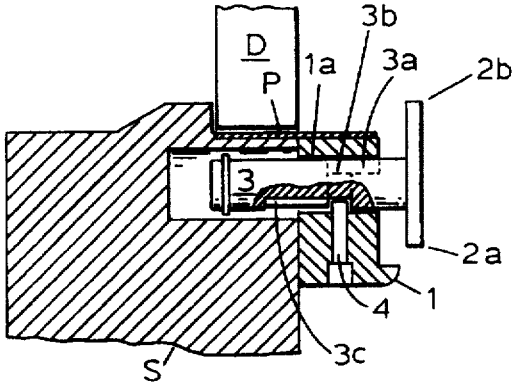
FIG. 2 is a view similar to FIG. 1 with the mechanism in a second position.
Figure 3:
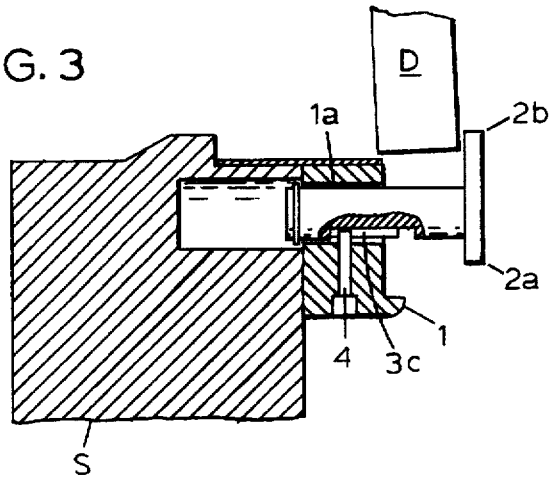
FIG. 3 is similar to FIG. 1 with the mechanism in a third position of actuation.

In FIGS. 1, 2, and 3 body 1 is fastened, preferably, by bolts (not shown) to the door frame structure S in a stowed or inactive position to clear the door D and is, preferably, fastened by screws (not shown) to the optional striker plate P. Bore 1*a* extends through the body 1 and slideably accepts arbor 3. A barrier plate 2 is transversely mounted on and is carried by arbor 3 relative to which it has a short side 2*a* and an extended side 2*b*. Body 1 carries a cam lug 4 arranged to cooperate with a groove in the arbor wall to control arbor movement. Groove 3*a* extends some distance along the wall of the arbor, connects to peripheral groove 3*b* (see FIG. 4) which allows the arbor to rotate a half turn. After the half turn, the groove 3*c* continues axially along the wall and allows the arbor to be pulled farther from the body which situates the extended side 2*d* of plate 2 to stop the door D after slight opening.

FIG. 2 shows the arbor and attached plate 2 pulled out to the position in which the cam and groove permits a half turn rotation. After the half turn, the plate extension 2*d* extends to interfere with the opening of the door. As shown in FIG. 3, groove 3*c* allows the arbor, plate and restrained door to move farther to provide a communication gap between door and frame. The plate is again stowed by reversing the described process for extending the plate. It is pushed in near the body for plate rotation and, once rotated, it can be pushed against the body and clears the door for opening.

Figure 4:
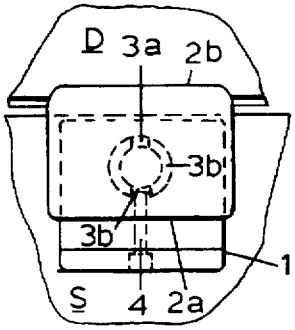
FIG. 4 is a right end view of FIG. 3.

FIG. 4 is an orthogonal view of FIG. 3, and shows the plate shape and the cam and groove relationship. The door can be only slightly opened due to the position of extension 2*b*.

Figure 5:
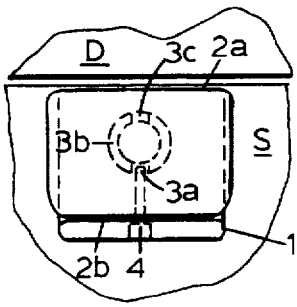
FIG. 5 is a right end view of FIG. 1.

FIG. 5 is a right end view of FIG. 1 showing the plate in the stowed position on body 1.

Figure 6:
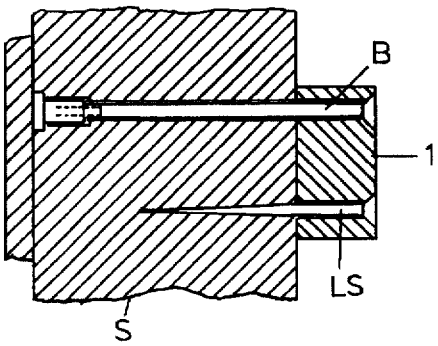
FIG. 6 is a symbolic section through a wall to which the mechanism is mounted.

FIG. 6 shows two of many mounting options. Bolts B may extend through the structure. Lag screws LS can be of sufficient size to withstand most forces expectable. Cap screws are not shown but may be used on common tubular frames for doors. Only the body 1 is present for the mounting process.

Figure 7:
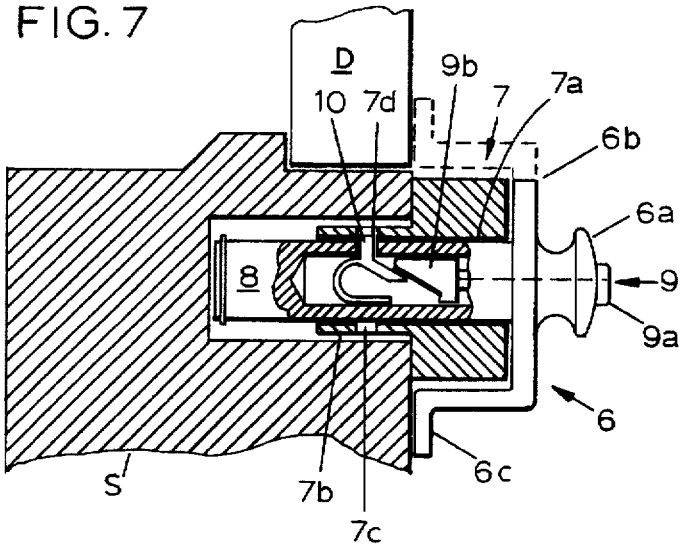
FIG. 7 is a top view, mostly cut away of an alternate embodiment of the door securing device.

FIG. 7 shows an alternate form of the device with a second extension on the plate 6 to secure the door in the closed position. It is shown in the stowed position. A push-button is arranged to release the arbor and plate from the axial position shown but this is the stowed position axially coincident with the door locked closed position noted by dashed lines. If it is not desirable to use the push button to move from the stowed position hole 7*d* can be omitted. Arbor 8 will then axially lock for button release only when the joggled flange 6*c* is securing the door. The cam lug and grooves differ only slightly from those already described herein and are shown later to avoid confusing details on FIG. 7. Body 7 has the extension 7*b* for lengthening the bore 7*a* which accepts the arbor 8 for close fit rotational and axial movement.

Figure 8:
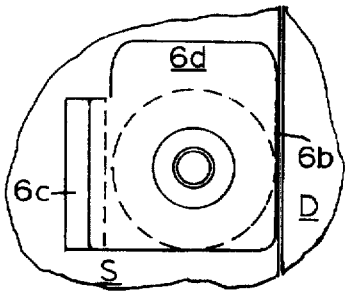
FIG. 8 is a front view, reduced in scale, of the device of FIG. 7 in a first, or stowed position.
Figure 9:
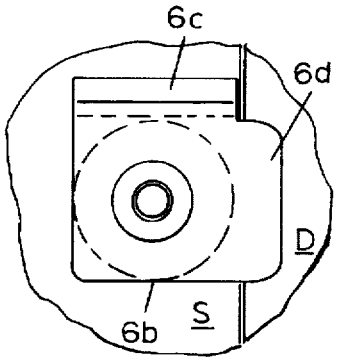
FIG. 9 is similar to FIG. 8 showing a second position of the device.
Figure 10:
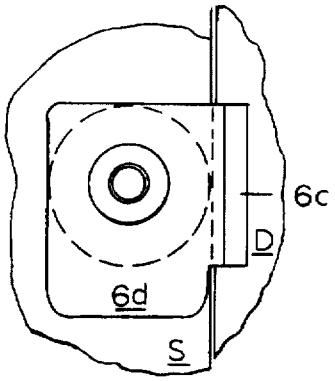
FIG. 10 is similar to FIG. 8 with the device in a third position of actuation.
Figure 11:
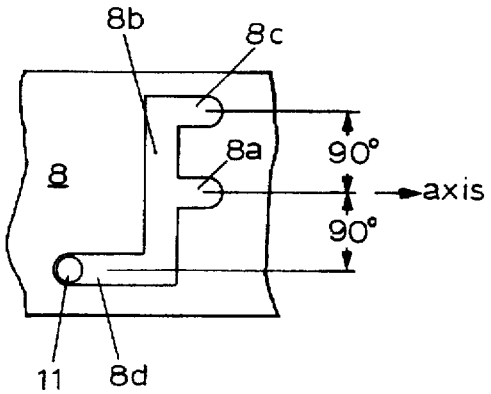
FIG. 11 is a development of arbor control grooves not shown on arbor 8 of FIG. 7.

Note in FIGS. 8, 9, and 10 that the arbor rotates only ninety degrees to change between functions served. In the stowed position of FIG. 8, lug 11 rests in groove 8*a* of FIG. 11. To change to the secured communication state of FIG. 9, plate 6 is pulled away from the body 7 to place lug 11 in groove 8*b* for rotation. The plate 6 is rotated to place extension 6*d* to stop the door as shown in FIG. 9 and the plate can move axially with lug it in groove 8*d* to permit safe communication through the resulting door opening. When the door is to be locked fully closed as in FIG. 10, plate 6 is pushed in until the cam lug can move in groove 8*b* to groove 8*c*. The plate is pushed in and sear 10 moves into hole 7*c*. Flange 6*c* holds the door fully closed until button 9*a* is pushed to cause cam 9*b* to release sear 10 to enable the arbor to move axially and permit the other options to be exercised.

It should be noted that the grooves can, in some cases, be spiraled between limits to allow the plate to be "wound out" to achieve both the rotational and axial positions desired simultaneously. Groove shapes and cam and groove relationships shown are not to be interpreted in a limiting sense.

Figure 12:
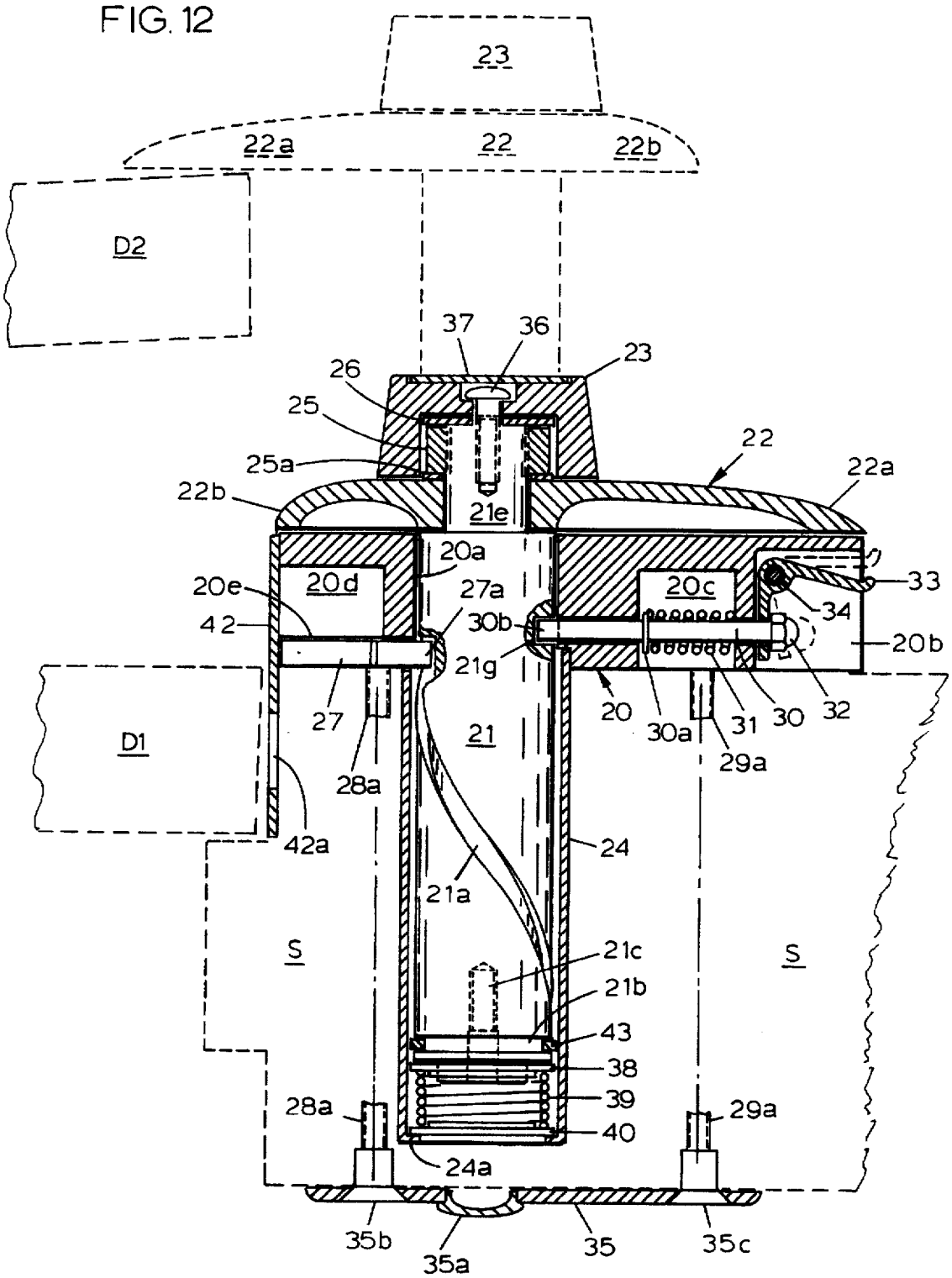
FIG. 12 is a top view, mostly cut away and approximately full scale, of the preferred embodiment.

FIG. 12 embraces the spiral groove concept and shows the preferred embodiment installed on the door framing structure S, viewed from the top and in the stowed or not activated state such that door D1 can be freely opened. Body 20 is secured to the structure by four fasteners, 28*a* and 29*a* being shown. Threaded rods are shown but cap screws or wood screws may be used to best serve the nature of the framing structure around the door. See FIG. 17 for disposition of all four mounting fasteners. Barrier plate 22 is positioned by ferrule 21*e* and rotationally secured to arbor 21 by nut 25 and washer 25*a*. The barrier plate has short side 22*b* and long side 22*a*. Knob 23 freely rotates on washer 26 and is retained by screw 36 which is covered by decal 37. Latch pin 30 is biased by spring 31 by way of retaining clip 30*a* into the mating latch recess 21*g* to hold the arbor in until trigger lever 33 is lifted to release the arbor to extend from bore 20*a*. Lock nut 32 engages the lever 33 and dowel 34 pivotally supports the lever on the body. Cam body 27 is retained on the body by recess 20*e* and extends cam 27*a* to engage spiral groove 21*a*. Shell tube 24 is a removable extension of the body with a bore that represents an extension of bore 20*a*. Recesses 20*b*, 20*c* and 20*d* are weight reduction contrivances and provide for the elements shown. Lock ring 43 in groove 21*b* limits the outward movement of the arbor by engaging the face of reduced bore 20*a*. Escutcheon plate 35 is not functionally necessary if screws 28*a* and 29*a* engage the structure S but it is convenient for motels and the like. Risers 35*b* and 35*c* may be part of the plate 35. Cover 35*a* allows access to left hand threaded bore 21*c* for emergency deactivation of the device as will be described later herein. The door framing structure S is in phantom and generally represents one of many possible structures to which the device may be attached. Spring 39 acts between the body and the arbor by way of bearing washers 38 and 40 and is confined in the body by flange 24*a*. Striker plate 42 is secured to the body by screws (not shown) and retains the cam body 27 in place and prevents the bolt of the conventional lockset on the door (not shown) from scraping the body when the door D1 is operated. In the actuated state the arbor extends and rotates plate 22 to place the long side 22*a* in a position to limit the amount the door, now shown as D2, can be opened as noted in dashed lines.

In panic situations, no thought or deliberate manipulation is required to clear the device from the door path. Knob 23 spins freely on the arbor and relative to plate 22. Pushing knob 23 accidentally or deliberately causes the arbor to spiral into the bore 20*a* until it is latched by latch pin 30. If trigger lever 33 is accidentally pulled before or after the plate is pushed to clear the door, while the plate is pushed against the body, no harm is done.

Properly assembled, plate 22 can be deliberately forced to rotate about neck 21*e* to move the plate out of the door path in case disruptive events jam the mechanism. That feature is adjustable, by tightening nut 25, during assembly.

Figure 13:
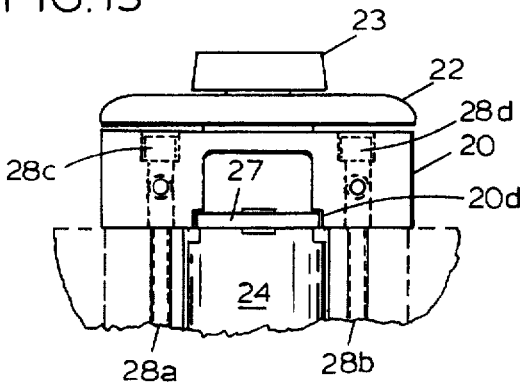
FIG. 13 is a front view somewhat reduced in scale, from the left side of FIG. 12 with some parts omitted for clarity.

FIG. 13 is a side view, from the door side, somewhat reduced in scale, of the device of FIG. 12. The striker plate is omitted (dashed lines show its location) and the door frame structure is shown in phantom. Mounting screws 28a and 28b are secured to the body by nuts 28c and 28d respectively. Cam 27 is positioned by recess 20d and is held in place by the striker plate when installed.

Figure 14:
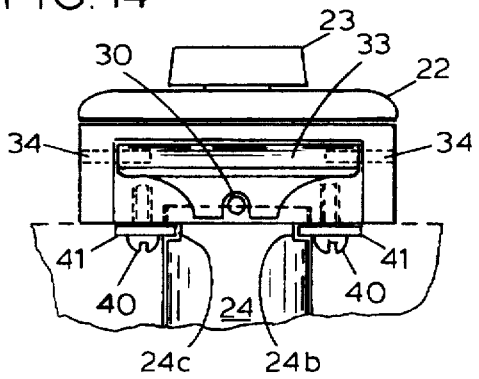
FIG. 14 is a back view, somewhat reduced in scale, from the right side of FIG. 12 with selected details emphasized.

FIG. 14 is the opposite side from that of FIG. 13. Screws 40, with washers 41 retain the shell 24 on the body by way of notches 24c. Dowels 34 pivotally support the trigger lever.

Figure 15:
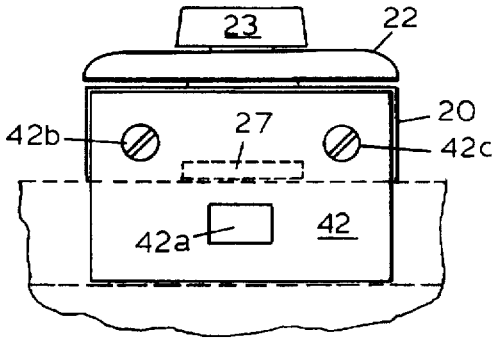
FIG. 15 is identical to FIG. 13 with some parts added.

FIG. 15 is identical to FIG. 13 with the striker plate installed. This shows plate mounting screws 42b and 42c and the opening 42a for the conventional door lockset bolt.

Figure 16:
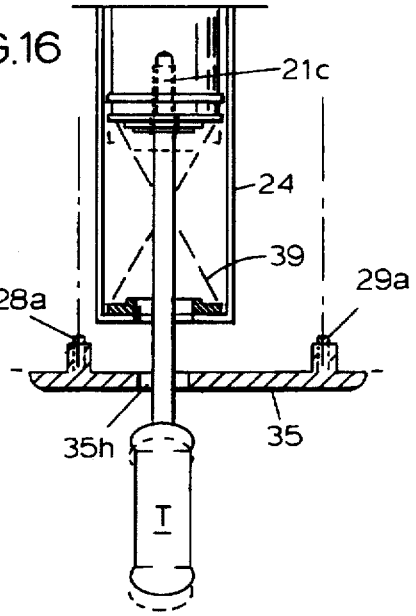
FIG. 16 is a top view from the aspect of FIG. 12 but showing only part of the installation with an optional manipulation device being shown.

FIG. 16 shows only part of the device and illustrates a feature useful for motels and the like for forcing the device into a stowed position to open the door in an emergency when occupants cannot deactivate it. Tool T has a shank with left hand threads to be inserted through hole 35h to be threaded into bore 21c after the escutcheon cover 35a is removed. The tool T is pulled to draw the arbor 21 until the latch pin 30 engages.

Figure 17:
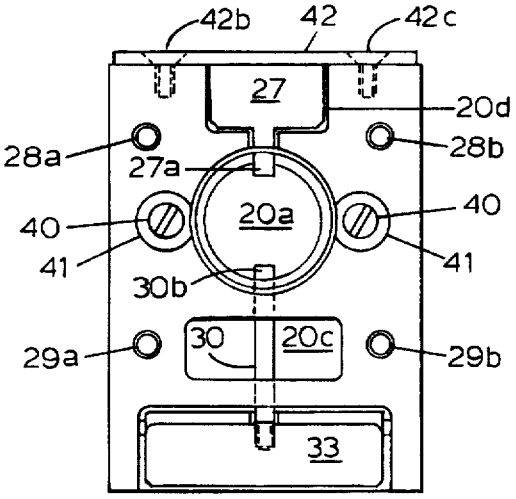
FIG. 17 is an orthogonal projection of FIG. 15 showing the base side.

FIG. 17 is a view from the base of the body. No arbor is present. This shows the layout of the mounting screws 28a, 28b, 29a and 29b as well as the location of screws 40 and washers 41.

Figure 18:
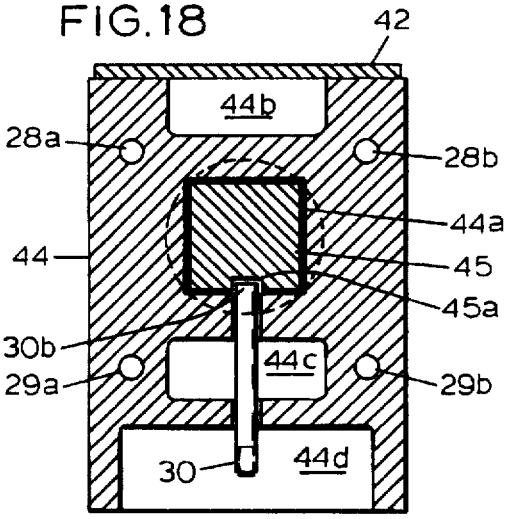
FIG. 18 is a plan view from the base side of the body sectioned along the latch rod centerline showing a spiraled square arbor and mating square bore.

FIG. 18 is a view from the same aspect as FIG. 17 for an alternate form of arbor and body bore. The arbor 45 is a spiraled square rod and has a mating spiraled bore 44a in body 44. The additional cam is not needed because the bore serves the rotational control function. The arbor, and mating bore are arranged to present a perpendicular face to the latch pin 30 and has latch pin mating recess 45a. The body is sectioned along the centerline of the latch pin. The spiraled square arbor requires no other changes in the body or other fittings. This represents a non-circular arbor cross section mating with a non-circular bore in the body, both representing a spiral along the arbor axis. Recess 44b is a weight reduction feature. Recesses 44c and 44d serve the functions previously described herein.

From the foregoing, it will be seen that this invention is one well adapted to attain all of the ends and objects hereinabove set forth, together with other advantages which are obvious and which are inherent to the device.

It will be understood that certain features and sub-combinations are of utility and may be employed without reference to other features and sub-combinations. This is contemplated by and is within the scope of the claims.

As many possible embodiments may be made of the device of this invention without departing from the scope thereof, it is to be understood that all matter herein set forth or shown in the accompanying drawings is to be interpreted as illustrative and not in a limiting sense.

The invention having been described, I claim:

1. A door locking device for attachment to a door frame to limit opening of an associated door toward an access side of said door frame, comprising:

a) a body with a base plane arranged for attachment to said door frame on said access side, having a bore extending generally perpendicular to said plane and a cam lug extending radially into said bore;

b) an arbor adapted to slideably fit said bore for axial and rotary movement therein, surfaces on said arbor defining a cam groove adapted to cooperate with said cam lug and to permit said arbor to move, from a stowed or first position, a first increment of axial distance to a second position, continuing peripherally around said arbor via a peripheral groove to allow said arbor to rotate to a third position, and proceed axially a second increment of axial distance to allow said arbor to extend to a fourth position relative to said body; and c) a barrier plate rotationally and axially attached to an end of said arbor on said access side for movement therewith and shaped relative to said arbor such that when said arbor is in said first position said plate lies near said body generally parallel to said plane, and when said arbor is rotated to said third arbor position said barrier plate extends beyond said plane a preselected amount to limit the opening of said door, said plate movable when said arbor is in said fourth arbor position to allow limited opening of said door.

2. The locking device of claim 1 wherein said peripheral groove has a peripheral extension to allow said arbor to rotate a preselected amount when in said stowed position to allow said plate to hold said door generally closed.

3. The device of claim 1 wherein said body is provided with a striker plate with an opening for a bolt.

4. The device of claim 1 wherein said body is provided with a detachable striker plate to extend along said frame.

5. A door securing device for mounting on structure defining a door opening, with a hinge mounted door situated thereon, for actuation to limit the opening of the door to a preselected mount, the device comprising:

a) a mounting body for attachment to said structure, having a base plane, and a door side generally perpendicular to said base plane, with a bore of non-circular transverse shape extending generally perpendicularly to said base plane as a spiral a preselected axial distance;

b) an elongated arbor with a non-circular transverse shape to mate with said non-circular bore for limited axial movement therein to compel rotation of said arbor when said arbor moves axially relative to said body;

c) a barrier plate transversely and rigidly attached to said arbor for axial and rotational sympathetic movement therewith, said plate having a periphery unevenly distributed radially from said arbor to provide a short side extending generally to said door side and a longer side extending beyond said door side when rotated to be adjacent said door side, said plate rotationally positioned on said arbor such that said short side is juxtaposed with said door side when said arbor has minimal extension from said body and said long side is juxtaposed with said door side when said plate is at a maximum distance from said body;

whereby said body can be mounted on said structure such that said plate will clear said door to move to an open position when said plate is pushed to a position near said body and said plate will rotate to limit the opening of said door when said plate is moved away from said body.

6. The device of claim 5 wherein a spring is situated in said bore to urge said plate to move away from said body.

7. The device of claim 5 wherein said bore is made non-circular by the extension of a cam radially into a cylindrical cross section and said arbor is made non-circular by the inclusion of a groove in the outer surface distributed as a helix to mate with said cam and said cylindrical cross section.

8. The device of claim 5 wherein a movable latch pin is arranged to extend from said body into a mating recess in said arbor to latch said arbor axially to said body when said plate is adjacent said body with manually actuatable trigger means situated on said body to pull said pin from said mating recess.

9. A door securing device for mounting on structure defining a door opening for actuation to limit the opening of an associated door to a preselected amount, the device comprising:

a) a mounting body with a base plane for attachment to said structure, and a door side of said body extending generally perpendicular to said base plane;

b) an elongated arbor with an axis and a non-circular transverse shape distributed as a spiral along said axis;

c) a bore in said body, extending generally perpendicularly to said base plane, shaped for a preselected axial distance to mate with and slideably accept said arbor;

d) a barrier plate transversely attached to said arbor for sympathetic movement therewith, said plate having a periphery unevenly distributed radially from said arbor such that part of its periphery extends generally to said door side when juxtaposed therewith and part of its periphery extends beyond said door side when juxtaposed therewith;

whereby said body can be mounted on said structure such that said plate will clear an opening door when said shaft is pushed to a position near said body and said plate will interfere with the opening of said door when said plate is moved to a position farther from said body.

10. The device of claim 9 wherein spring biased latch means is situated in said body to engage said arbor when said plate is positioned to clear said door, with a trigger lever mounted on said body to release said latch means to allow said arbor to move axially relative to said body.

11. The device of claim 10 wherein spring means is situated to act between said body and said arbor to urge said plate to move away from said body.

12. The device of claim 9 wherein said barrier plate is rotationally attached to said arbor by friction, whereby said barrier plate can be forcefully rotated relative to said arbor.

13. The device of claim 9 wherein a knob is axially secured to said barrier plate opposite said arbor for rotation relative to said barrier plate, whereby the device can be deactivated by a simple thrust against said knob.

* * * * *